US008317237B1

(12) United States Patent
Fannon et al.

(10) Patent No.: US 8,317,237 B1
(45) Date of Patent: Nov. 27, 2012

(54) RELEASE HANDLE FOR VEHICLE CLOSURE LID LATCH

(75) Inventors: Joseph P. Fannon, Washington, MI (US); John K. Quinlan, Oakland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/219,043

(22) Filed: Aug. 26, 2011

(51) Int. Cl.
*E05B 3/00* (2006.01)
*E05B 3/08* (2006.01)

(52) U.S. Cl. ..... 292/336.3; 292/336.5

(58) Field of Classification Search ..... 248/27.1, 248/27.3; 292/336.3, 336.5, DIG. 30, DIG. 42, 292/DIG. 27
See application file for complete search history.

(56) References Cited

U.S. PATENT DOCUMENTS

| | | | | |
|---|---|---|---|---|
| 4,023,435 | A * | 5/1977 | LaDue | 74/502.4 |
| 4,266,816 | A * | 5/1981 | Mukai et al. | 292/129 |
| 4,635,498 | A * | 1/1987 | Zimmermann et al. | 74/502.4 |
| 5,263,750 | A * | 11/1993 | Smith et al. | 292/336.3 |
| 6,086,131 | A * | 7/2000 | Bingle et al. | 296/76 |
| 6,394,511 | B1 * | 5/2002 | Lam et al. | 292/336.3 |
| 6,527,313 | B2 * | 3/2003 | Takahashi et al. | 292/336.3 |
| 7,029,138 | B2 * | 4/2006 | Tibbenham et al. | 362/84 |
| 7,188,545 | B2 * | 3/2007 | Nagle et al. | 74/502.6 |
| 7,225,702 | B2 * | 6/2007 | Fannon et al. | 74/502.4 |

* cited by examiner

*Primary Examiner* — Thomas Beach
*Assistant Examiner* — Nathan Cumar

(57) ABSTRACT

A handle assembly is mounted on a vehicle body and includes a handle pulled by a user to pull a cable and release a remotely located latch, such as a luggage compartment lid latch, engine compartment lid latch, or fuel filler door lid latch. The handle assembly includes a bezel having a guide channel structure for slidably mounting the handle and defining a path for straight-line pulling of the cable. The guide channel structure is formed in part by a flexible wall, such as a flexible finger on the bezel that yieldably bears upon the handle, so that if the user pulls the handle at an angle to the straight-line pull axis of the cable, the flexible finger flexes to permit the handle to pivotally shift within the bezel to the angle established by the user, and without kinking the cable.

19 Claims, 2 Drawing Sheets

RELEASE HANDLE FOR VEHICLE CLOSURE LID LATCH

FIELD OF THE INVENTION

The present invention relates to the operation of a latch in a motor vehicle and more particularly provides an improved handle assembly for pulling a cable to release the latch so that a lid can be opened.

BACKGROUND OF THE INVENTION

It is known in motor vehicles to provide closure panels, such as an engine compartment lid, a luggage compartment trunk lid, and a fuel filler door lid. The lid is connected to the vehicle body by hinges, and a latch is provided for latching the lid in the closed position. It is desirable to provide a remotely located handle for unlatching the latch. The handle is connected to the latch by a cable. In the case of the engine compartment lid or fuel filler door lid, the handle can be located in the passenger compartment. In the case of the luggage compartment lid, the handle can be located in either the passenger compartment or inside the luggage compartment. It is also desirable to improve the aesthetics of the vehicle by concealing the cable behind a decorative trim panel or carpeting, with only the handle visible and accessible to the user.

It would be desirable to provide an improved handle assembly for remotely unlatching a closure lid latch, with the handle assembly preventing any kinking of the cable even if the user pulls the handle at an angle with respect to the axis of cable.

SUMMARY OF THE INVENTION

A handle assembly is mounted on a vehicle body and includes a handle pulled by a user to pull a cable and release a remotely located latch, such as a luggage compartment lid, engine compartment lid, or fuel filler door lid. The handle assembly includes a bezel having a guide channel structure for slidably mounting the handle and defining a path for straight-line pulling of the cable. The guide channel structure is formed in part by a flexible wall, such as a flexible finger on the bezel that yieldably bears upon the handle, so that if the user pulls the handle at an angle to the straight-line pull axis of the cable, the flexible finger flexes to permit the handle to pivotally shift within the bezel to the angle established by the user, and without kinking the cable.

It should be understood that the detailed description and specific examples, while indicating exemplary embodiments of the invention, are intended for purposes of illustration only and do not limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is merely exemplary in nature and is not intended to limit the invention, its application, or uses.

Figure 1:
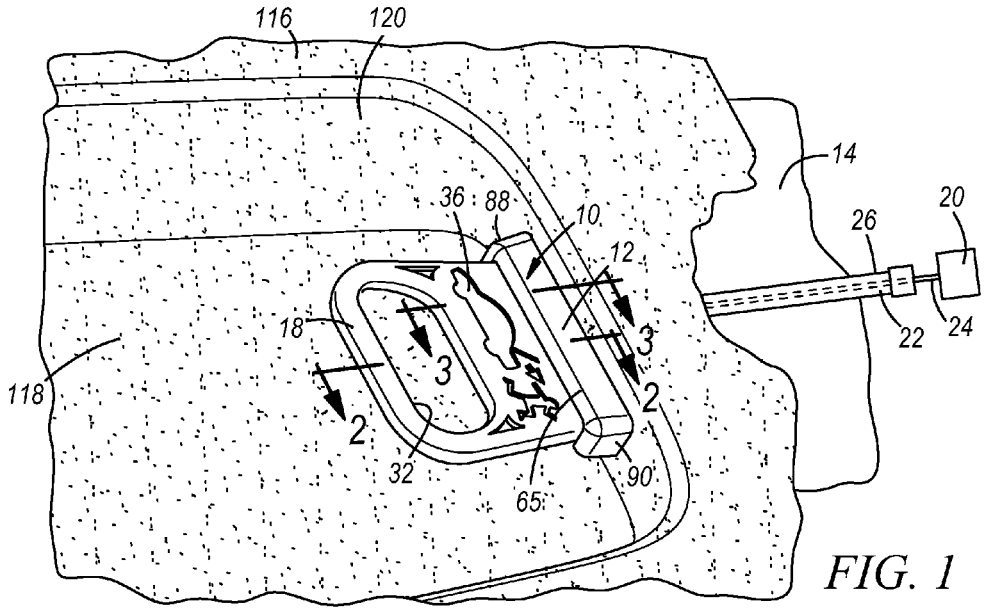
FIG. 1 is a perspective view of the handle assembly of this invention, with a molded carpet panel installed over the handle assembly to conceal the cable that extends to the latch.

Referring to FIG. 1, a handle assembly, generally indicated at 10, includes a bezel 12 that is mounted on a sheet metal mounting panel 14 of the vehicle body. The handle assembly 10 also includes a handle 18 connected to a remote latch 20 by a cable assembly 22 that includes a cable 24 housed within a sheath 26. The handle 18 has a finger slot 32 for gripping by the user to pull the handle 18 and thereby release the latch 20. The handle 32 has an indicia 36 in the shape of a vehicle body having the luggage compartment lid shown in the open position and a human-like figure escaping from the luggage compartment.

Figure 2:
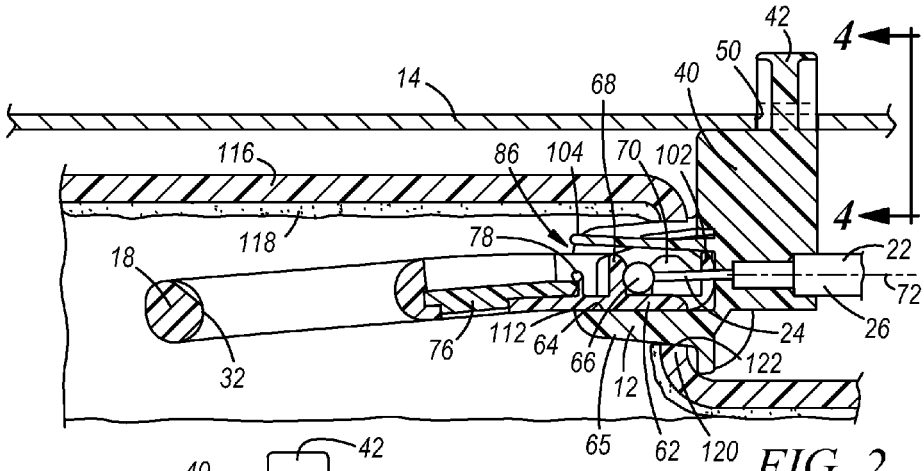
FIG. 2 is a section view taken in the direction of arrows 2-2 of FIG. 1.
Figure 3:
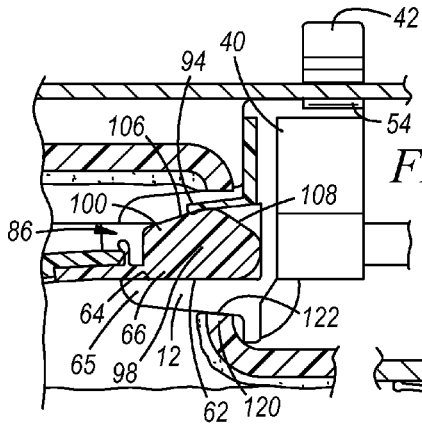
FIG. 3 is a section view taken in the direction of arrows 3-3 of FIG. 1.
Figure 4:
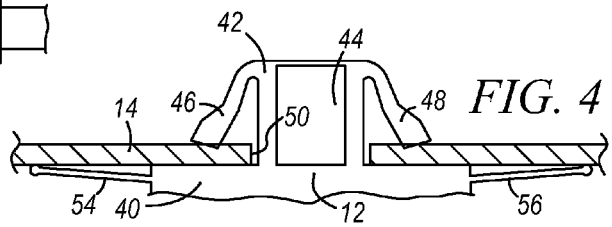
FIG. 4 is a section view taken in the direction of arrows 4-4 of FIG. 2.

Referring to FIGS. 2, 3 and 4, it is seen that the bezel 12 of the handle assembly 10 includes a molded plastic housing 40 having an integrally molded fastener 42 mounting the bezel 12 on the mounting panel 14. As best seen in FIG. 4, the fastener 42 includes a stem 44 having retaining fingers 46 and 48 that will flex inwardly toward this stem 44 to permit insertion of the stem 44 through a mounting hole 50 of the mounting panel 14. Then, the retaining fingers 46 and 48 will flex outwardly to overlie the back side of the mounting panel 14 as seen in FIG. 4. The housing 40 has a pair of flexible biasing fingers 54 and 56 that are molded integral with the housing 40 and bear against the front face of the mounting panel 14, so that the retaining fingers 46 and 48 and the biasing fingers 54 and 56 cooperate to effectively mount the bezel 12 on the mounting panel 14.

Figure 5:
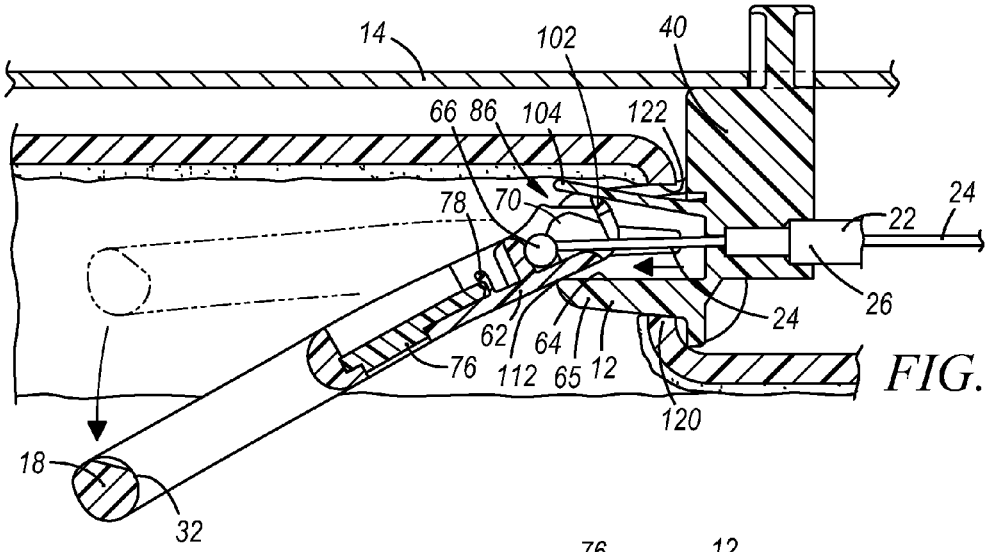
FIG. 5 is a view similar to FIG. 2 but showing a user pulling on the handle at an angle, to pull the cable and unlatch the latch.
Figure 6:
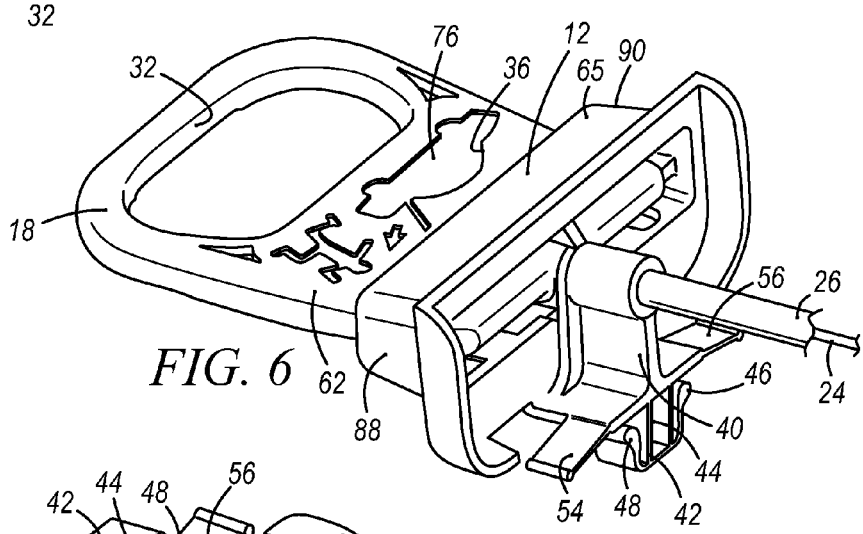
FIG. 6 is a perspective view of the handle assembly.
Figure 7:
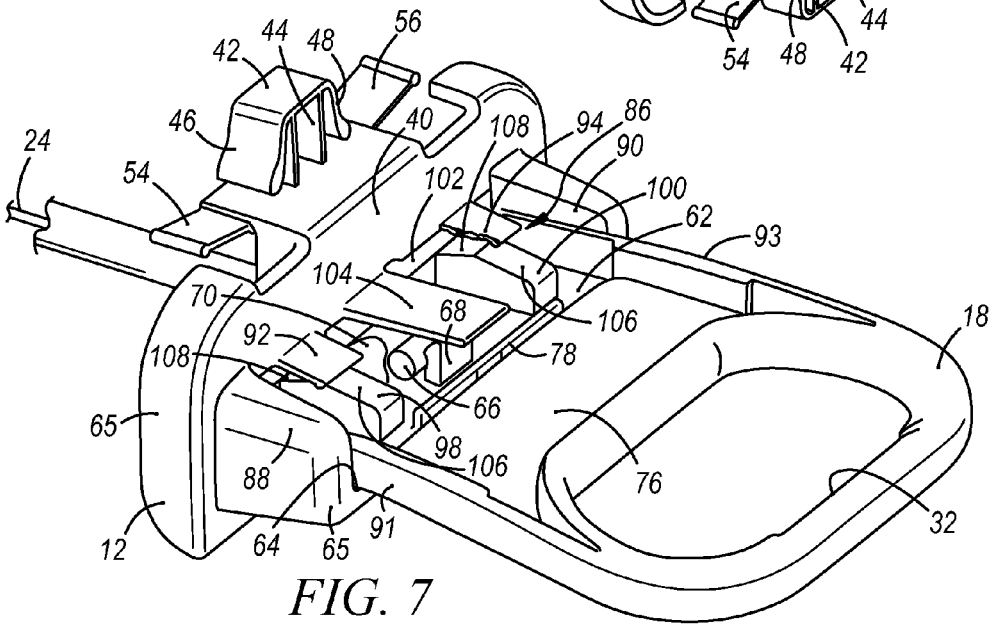
FIG. 7 is another perspective view of the handle assembly.

As seen in FIGS. 2, 5, and 6, the handle 18 is of molded plastic construction and includes a planar base wall 62 that slides on a support wall 64 of a collar 65 that projects from the housing 40 of the bezel 12. As seen in FIGS. 2 and 7, the cable 24 has a retainer pin 66 mounted on the end thereof and the retainer pin 66 is attached to the handle 18 by being captured between retainer tabs 68 and 70 that are molded integrally with the planar base wall 62 of the handle 18. The sheath 26 of cable assembly 22 is retained in a recess of the housing 40 to position the cable 24 along a straight-line pull axis 72.

The handle 18 can be molded of any color plastic, but can be molded of a brightly colored plastic, such as yellow, so as to be readily visible to the user. The indicia 36, previously seen and discussed in FIG. 1, is provided on the handle 18 by molding a window in the planar base wall 62 in the shape of the vehicle body and the human-like figure. As best seen in FIG. 2, an insert panel 76 is retained on the planar base wall 62 of the handle 18 by a snap finger 78. The insert panel 76 is molded of a phosphorescent or brightly colored plastic, such as red, that contrasts with the color of the handle 18, so that the indicia 36 is highly visible to the user. Thus the handle can be black plastic and the insert can be a phosphorescent plastic.

The bezel 12 has a guide channel structure 86 for slidably mounting the handle 18 on the bezel 12 for movement of the handle 18 between its stored position of FIG. 2 and its pulled position of FIG. 5. The guide channel structure 86 includes the support wall 64 of the collar 65 of the housing 40, upon which the planar base wall 62 of the handle 18 slides. The guide channel structure 86 also includes a pair of laterally spaced end walls 88 and 90 of the bezel 12 that capture the sidewalls 91 and 93 of the handle 18. In addition, the guide channel structure 86 also includes a pair of guide tabs 92 and 94 that, in the stored position of the handle, bear down upon abutments 98 and 100 that are molded integrally with the handle 18. As best seen in FIGS. 3 and 7, the abutments 98 and 100 each include an inclined surface 106 and a declined surface 108. The channel structure 86 also includes a flexible wall portion in the form of flexible finger 104 that bears down upon an end wall 102 of the handle 18.

Referring again to FIGS. 1 and 2, it is seen that a molded trim panel 116, particularly a piece of molded carpeting, is installed to conceal the inner workings of the handle assembly 10 and the cable assembly 22. The trim panel 116 is formed with a depressed pocket 118 therein having a sidewall 120. The sidewall 120 has a rectangular cutout 122 which permits the trim panel 116 to be installed over the bezel 12. As seen in FIGS. 1 and 2, the collar wall 65 and the laterally spaced end walls 88 and 90 of the bezel 12 extend outwardly through the rectangular cutout 122 so that the trim panel 116 is closely supported on the bezel 12 in an aesthetically pleasing manner which conceals the inner workings of the handle assembly 10 and conceals the cable assembly 22. As seen, the collar wall 65 is tapered to facilitate the installation of the molded trim panel 116 onto the collar wall 65 and to accept any thickness of the trim panel 116 and provide an aesthetically pleasing interface between the trim panel 116 and the bezel 12. Because the handle assembly 10 is positioned within the depressed pocket 118, the handle 18 is protected from entanglement with luggage or other objects.

Operation

Referring to FIG. 2, the handle 18 has not been pulled and is effectively stored within the guide channel structure 86 of the bezel 12. In particular, as best seen in FIGS. 2, 3, and 7, the planar base wall 62 of the handle 18 is resting on the support wall 64 of the bezel 12. The end wall 102 of the handle 18 is engaging housing 40, and, as shown in FIGS. 3 and 7, the guide tabs 92 and 94 are bearing down on the inclined surfaces 106 of the abutments 98 and 100. Thus, as seen in FIG. 2, the handle 18 is stored and aligned in a position that is in a straight-line relationship with the axis of the pull cable 24.

Referring to FIG. 5, the handle 18 has been gripped by a user and pulled to the left. A straight-line pull of the handle 18 in the direction of the axis of the cable 24 would result in the handle 18 being located at the phantom-line indicated position of FIG. 5. However, in FIG. 5, it is seen that the user has pulled the handle 18 at a downward angle, which is a natural inclination of the user since the user is naturally positioned off to the side of the mounting panel 14 upon which the handle assembly 10 is mounted. Thus, in FIG. 5, the handle 18 has effectively pivoted and slid about distal edge 112 of the support wall 64 to the solid line position shown in FIG. 5. This pivoting, and sliding, and shifting motion of the handle 18 has been permitted by the progressive leftward motion of the handle 18 so that the abutments 98 and 100 of the handle 18 have moved leftwardly and out from underneath the guide tabs 92 and 94. In particular, as seen in FIG. 3, the inclined surface 106 of the abutment 98 will be withdrawn leftwardly from beneath the guide tab 94, and then the declined surface 108 will begin to allow the abutment 98 to pivot upwardly with the handle 18 as the leftward movement progresses to the fully pulled position of FIG. 5.

As seen in FIG. 5, during this leftward motion of the handle 18, the flexible finger 104 has been pivoted by its engagement with the end wall 102 of the handle 18 as needed to accommodate the pivoting and sliding movement of the handle 18 about the distal edge 112. It will be understood that the flexible finger 104 provides a downward bias on the end wall 102 which maintains pressure on the handle 18 so that the handle 18 does not become loose within the bezel 12. Thus, the flexible finger 104, by its flexure, comprises a flexible wall portion of the channel structure 86, and this flexible wall portion can flex and vary to accommodate the various angles at which the user might have pulled the handle 18. In addition, it is seen in FIG. 5 that the cable 24 is being pulled in a straight-line along the axis 72 of the cable even though the handle 18 has been pulled at an angle with respect to the straight-line axis 72 of the cable 24.

When the latch 20 has been released and the user releases the handle 18, the cable 24 will pull the handle 18 rightwardly again and the flexible finger 104 will pivot the handle 18 back to its un-rotated and stored position of FIG. 2, with the abutments 98 and 100 again seated beneath the guide tabs 92 and 94. In the stored position, the handle 18 is protected within the depressed pocket 118.

Thus, it is seen that the invention has provided a handle assembly 10 in which the unique channel structure 86 including a flexible wall in the form of the flexure finger 104 which can yield as needed to accommodate a pivoting motion of the handle 18 as the handle 18 is pulled by the vehicle user. In this manner, the cable 24 will be pulled along its straight-line axis without kinking of the cable 24 even if the handle 18 is pulled at an angle.

What is claimed is:

1. A handle assembly for pulling a cable to unlatch a closure panel latch in a motor vehicle, comprising:

a handle for gripping by the user;

a cable connected to the handle and extending to the latch so that gripping and pulling the handle in a straight-line pulls the cable in said a straight-line to unlatch the latch;

a bezel for mounting on a mounting panel of the motor vehicle, said bezel having a guide channel structure formed therein for slidably mounting the handle for straight-line pulling within the channel structure and defining a path for straight-line pulling of the cable, said guide channel structure being formed in part by a flexible finger on the bezel yieldably bearing upon the handle so that if the user pulls the handle at an angle to the straight-line pull of the handle and of the cable, the flexible finger flexes to permit the handle to pivotally shift within the bezel to the angle established by the user, whereby the handle is both pullable in a straight-line and pivotable at an angle to the straight-line pull within the bezel.

2. The handle assembly of claim 1 further comprising the bezel having an integrally formed fastener thereon which seats within a mounting hole provided on the mounting panel to mount the bezel upon the mounting panel.

3. The handle assembly of claim 1 further comprising a sheath surrounding the cable and the sheath having an end mounted on the bezel with an end of the cable projecting into the guide channel structure of the bezel and connected to the handle.

4. The handle assembly of claim 3 further comprising the cable having a retainer formed on an end of the cable and the handle having a pair of retainer tabs capturing the retainer therebetween.

5. The handle assembly of claim 1 further comprising the bezel having a collar wall that extends through a slot in a trim panel that conceals the cable.

6. The handle assembly of claim 1 further comprising the handle being of a chosen color and having a window therein in the shape of an indicia that indicates the operation of the panel to the user, and an insert installed on the handle and visible through the window said insert being of a color that contrasts with the chosen color of the handle.

7. The handle assembly of claim 1 further comprising the bezel having guide tabs that bear upon abutments carried by the handle, the tabs engaging the abutments to establish a normal position of the handle until the pulling of the handle withdraws the abutments away from the guide tabs permitting the pivoting and sliding movement of the handle relative to the bezel.

8. The handle assembly of claim 1 further comprising the bezel having an integrally formed fastener thereon which seats within a mounting hole provided on the mounting panel to mount the bezel upon the mounting panel, and the bezel having a collar wall that extends through a slot in a trim panel that conceals the cable.

9. The handle assembly of claim 1 further comprising the cable having a retainer formed on an end of the cable and the handle having retainer tabs capturing the retainer, and the bezel having at least one guide tab that bears upon at least one abutment carried by the handle, the at least one guide tab engaging the at least one abutment to establish a normal position of the handle until the pulling of the handle withdraws the at least one abutment away from the at least one tab, permitting the pivoting movement of the handle relative the base.

10. The handle assembly of claim 9 further comprising the handle being of the chosen color and having a window therein in the shape of an indicia that indicates the operation of the handle to the user, and an insert installed on the handle and visible through the window, said insert being of a color that contrasts with the chosen color of the handle.

11. A handle assembly for pulling a cable to unlatch a closure panel latch in a motor vehicle, comprising: a handle for gripping by the user;

a cable connected to the handle and extending to the latch so that gripping and pulling the handle in a straight-line pulls the cable in said straight-line to unlatch the latch;

a bezel, said bezel having an integral fastener for mounting the bezel on a mounting panel of a motor vehicle, said bezel having a collar that extends through a cutout in a trim panel, said bezel having a guide channel structure formed therein for slidably mounting the handle for straight-line pulling within the channel structure and defining a path for straight-line pulling of the cable, said guide channel structure including a flexible finger yieldably bearing upon the handle, said flexible finger flexing if the user pulls the handle at an angle to a straight-line pull of the handle, to permit the handle to pivotally shift within the bezel to the angle established by the user and maintain the straight-line pulling of the cable.

12. The handle assembly of claim 11 further comprising the handle having indicia thereon indicating to the user the type of latch which will be operated by pulling the handle.

13. The handle assembly of claim 11 further comprising the handle being of a chosen color and having a window therein in the shape of an indicia that indicates the operation of the panel to the user, and an insert installed on the handle and visible through the window said insert being of a color that contrasts with the chosen color of the handle.

14. The handle assembly of claim 13 further comprising the insert being an insert panel mounted on the handle by a snap finger formed on the handle and engaging the insert panel.

15. The handle assembly of claim 11 further comprising the bezel having guide tabs that bear upon abutments carried by the handle, the guide tabs engaging the abutments to establish a normal position of the handle until the pulling of the handle withdraws the abutments away from the tabs, permitting the pivoting movement of the handle relative to the base.

16. The handle assembly of claim 11 further comprising the integral fastener for mounting the bezel on a mounting panel of a motor vehicle including a stem that projects through a mounting hole provided in the mounting panel and a pair of retaining fingers that flex and engage with a back side of the mounting panel.

17. The handle assembly of claim 16 further comprising the integral fastener for mounting the bezel on the mounting panel including a pair of biasing fingers that flex and engage with a front side of the mounting panel to assist the retaining fingers in mounting the bezel on the mounting panel.

18. A handle assembly for pulling a cable to unlatch a closure panel latch in a motor vehicle, comprising:

a handle for gripping by the user;

a cable connected to the handle and extending to the latch so that gripping and pulling the handle pulls the cable to unlatch the latch;

a bezel, said bezel having an integral fastener for mounting the bezel on a mounting panel of a motor vehicle, said bezel having a collar that extends through a cutout in a trim panel, said bezel having a guide channel structure formed therein for slidably mounting the handle for straight-line pulling within the channel structure and defining a path for straight-line pulling of the cable, the bezel having guide tabs that bear upon abutments carried by the handle, the guide tabs engaging the abutments to establish a normal position of the handle until the pulling of the handle withdraws the abutments away from the tabs permitting the pivoting movement of the handle relative the bezel, and said guide channel structure including a flexible finger yieldably bearing upon the handle, said flexible finger flexing if the user pulls the handle at an angle to a straight-line pull of the cable to permit the handle to pivotally shift within the bezel to the angle established by the user and maintain the pull of the cable at the straight-line path.

19. The handle assembly of claim 18 further comprising the handle being of a chosen color and having a window therein in the shape of an indicia that indicates the operation of the panel to the user, and an insert installed on the handle and visible through the window, said insert being of a color that contrasts with the chosen color of the handle.

* * * * *